United States Patent [19]

Schwartz

[11] 4,137,486

[45] Jan. 30, 1979

[54] ELECTRON BEAM CATHODOLUMINESCENT PANEL DISPLAY

[75] Inventor: James W. Schwartz, Deerfield, Ill.

[73] Assignee: Zenith Radio Corporation, Glenview, Ill.

[21] Appl. No.: 899,933

[22] Filed: Apr. 25, 1978

Related U.S. Application Data

[63] Continuation-in-part of Ser. No. 735,465, Oct. 26, 1976.

[51] Int. Cl.[2] ..... H01J 29/70; H01J 29/72

[52] U.S. Cl. ..... 315/366; 313/422

[58] Field of Search ..... 315/366, 13 R; 313/422, 313/427

[56] References Cited

U.S. PATENT DOCUMENTS

| | | | |
|---|---|---|---|
| 4,076,994 | 2/1978 | Anderson | 315/366 |
| 4,088,920 | 5/1978 | Siekanowicz et al. | 313/422 |

*Primary Examiner*—Theodore M. Blum

*Attorney, Agent, or Firm*—Ralph E. Clarke, Jr.

[57] ABSTRACT

This disclosure depicts an image display panel partitioned into two distinct sections comprising a high voltage front section and a low voltage rear section. An electron source means located in the low-voltage rear section is disposed along a row-wise edge of the panel for generating a supply of electrons. A plurality of low-energy electron beams drawn from the electron source means are formed, shaped and modulated. Each beam is directed into a beam guide-isolator responsive to relatively low applied beam control voltages. The beams are further directed by the plurality of beam guide-isolators perpendicular to said edge and parallel to the image display panel faceplate, and are repetitively, and preferably substantially periodically, focused and refocused to constrain the electrons from leaving the beam guide-isolators. Beam diverting means responsive to the application of relatively low applied beam diverting voltages sharply divert the beams through apertures in the beam guide-isolators from selected precise positions opposite the faceplate. The electrons of each beam are accelerated to a high energy in the high voltage front section to activate cathodoluminescent phosphor targets. Means are disclosed for confining the upward travel of the beam and for diverting the beam towards a faceplate; the means comprise pairs of opposed parallel walls having deposited thereon at least two electrode patterns each electrically linked to a substantially mirror-image electrode pattern deposited on the opposed parallel wall.

7 Claims, 22 Drawing Figures

154B
155
154A
153
152A
148
147B
152B
147A
144A
162A-x
163A-x
row x
142
144B
140
86
84
78

ELECTRON BEAM CATHODOLUMINESCENT PANEL DISPLAY

CROSS REFERENCE TO RELATED PATENT APPLICATIONS

This application is a continuation-in-part of application Ser. No. 735,465 filed Oct. 26, 1976 and assigned to the assignee of the present invention.

BACKGROUND OF THE INVENTION AND PRIOR ART STATEMENT

This invention concerns an electron beam cathodoluminescent panel display suitable for the display of television pictures. It is also useful for other image displays such as alphanumeric, computer and computer graphics.

The achievement of a feasible and practical flat panel television display has long been a goal of technologists in many parts of the world. However, to have widespread commercial significance, any such display must be technically and economically competitive with conventional cathode-ray picture tubes.

Such picture tubes are in an advanced state of refinement. In many respects, the attainable picture performance of the picture tube is at such a high level that there is little practical incentive for further technological improvemments. Contrast ratios, brightness levels, raster linearity, interlace and color field registration are quite acceptable to television viewers. Resolution, particularly in picture highlight areas, however, generally falls discernibly below theoretical system limits. This impediment is being overcome, however, by new types of high-resolution electron guns coming into use.

Conventional picture tubes do have characteristics that provide incentive to create a commercially viable alternative such as the flat panel display. For example, the largest color tubes commonly in current production have a display screen with an approximately 25-inch diagonal measurement, providing about 315 square inches of viewing area. The 25-inch measurement does not represent an absolute physical limit, but there are a number of practical considerations which rule out any major increase. Volume, weight and cost of the picture tube envelope tend to increase very rapidly for even modest increases in picture area. In addition, equivalent brightness and resolution are difficult if not impossible to attain in larger configurations.

In view of these disadvantages, the flat panel display represents a highly attractive alternative. An ideal panel display would provide picture performance equal to or exceeding the present quality levels of the picture tube, and would not be so rigorously size-limited.

A major effort in creating a flat panel display has been directed to the gas-discharge type; however, panels developed to date have not demonstrated adequate efficiency. In view of this fact, the efficiency of the electron beam of the picture tube in activating cathodoluminescent materials makes the use of such beams highly attractive in a panel display. Also, there is a wealth of readily available picture tube technology that is applicable to a panel display using electron beams; phosphor materials and application methods, high vacuum processing and fabrication techiques, and well-developed electron-optical design fondations are prime examples.

A significant drawback to the evolution of panel displays that can lend themselves to manufacture, and that can be economically mass-produced, is structural complexity. Panel displays are typically made up of an aggregation of discrete display elements each of which represents one unit of color information, or black and white information. Each display element may have components for electron beam guidance, channeling, directing, and accelerating, and, (in some cases) scanning the beam so that it selectively impacts one or more discrete cathodoluminescent phosphor targets, or, a photoluminescent compound. The display elements are typically separated by numerous spacers, usually insulative in nature. As a result of the multiplicity of its functions each display element in a cathodoluminescent display may in itself be quite complex in structure. This complexity is compounded by the fact that a quarter-of-a-million such display elements may be required in a black-and-white display, and as many as three-quarters of a million may be required for a color display. In view of the magnitude of such numbers, what may initially have seemed to be a relatively simple panel concept becomes staggering in structural complexity.

The problems of panel construction are compounded by the fact that the luminance output characteristics of all display elements must be substantially identical otherwise luminance non-uniformities readily perceptible to the eye can result. To achieve the necessary identicality in performance, the physical dimension of all display elements must in turn be substantially identical, and the passageways, whether for the conveyance of radiation or of particles, must also be substantially identical. Another troublesome requirement imposed upon spacer-support structures in many panel applications is that the display cell passageways be relatively deep, compared to their smallest lateral dimension. For example, the passageways in some applications necessarily must each have a front-to-back depth which is many times their narrowest width dimension.

Problems also beset the manufacture of said panel displays. Display panels are commonly fabricated by "stacking" elements such as beam-guiding electrodes, insulative spacers, and plate structures such as cathodes and anodes. In stacking such elements, tolerance build-ups may occur with the result that dimensions can vary intolerably across the length and width of the panel. Element forming and shaping methods may also present serious problems. Perhaps the most common method employed in fabricating such structures is by the use of photo-etching techniques. One of the problems attending the use of certain etching methods is that the etched material is "undercut" at a rapid rate. Inadequate dimensional accuracy and high cost also plague certain etching methods. None of the prior art panel structures have been found to be completely satisfactory. Most if not all have severe limitations in terms of their cost. Most are deficient in their ability to produce structures having passageways whose individual depth is greater than its smallest lateral dimension. Certain of these prior art approaches cannot meet the degree of accuracy, placement and configuration of the passageways which is required; other approaches fail when subjected to the severe thermal cycling operations which a panel must undergo during its fabrication. In short, there exists a very strong need for an improved structural component and electrode forming means in panel displays.

An attempt to utilize the electron beam in a flat panel display is shown by the "Aiken" tube (refer to FIG. 1) wherein a pair of electron guns 10 project beams 12 parallel to two enveloping plates 14 and 16, one of which is transparent. Beams 12 are diverted to fall upon opposite sides of cathodoluminescent surface 18. The beams are diverted by deflection plates 20 and 22, which are used to scan surface 18 in vertical and horizontal directions to produce an image. The concept is covered in a series of U.S. patents by Aiken, including U.S. Pat. No. 3,313,970. The beams are of high energy, and high potentials on the deflection plates are required to divert the beams toward the cathodoluminescent surface. Color rendition has also been less than ideal. Further, since the envelope is not self-supporting against atmospheric pressure, the concept would seem to be adaptable to only relatively small displays.

Gabor has disclosed a three-beam flat panel color display tube shown in highly simplified schematic form in FIG. 2. Three electron beams 24 are generated by electron gun 26, and turned back one hundred and eighty degrees around barrier 28 into an adjacent beam channel 30, where the beams are diverted again ninety degrees by electrodes 32 to impinge upon and scan cathodoluminescent color phosphor screen 34 through a shadow mask 36. This concept is covered in U.S. Pat. No. 3,171,056, among others. The Gabor tube is a very complex structure which must be made with extreme precision. Beam energies are relatively high, and high deflection potentials are required to scan the beam. It is believed that a complete operative tube has never been made. It is also thought that such a tube, if realizable, would be seriously effected by external influences such as the earth's magnetic field. Like the Aiken tube, it is not a self-supporting structure so its use would also be restricted to relatively small displays.

Charles, in U.S. Pat. No. 3,723,786, discloses a flat cathode-ray tube for direct viewing spot display of letters and numbers, as shown in simplified perspective form in FIG. 3. A longitudinal heater strip 38 comprising a series of thermionic emitters generates electrons which are formed into a series of electron beams 40 modulated by a succession of grids 42. The beams enter a space between two facing plates, one a backplate 44 having a series of horizontal strip electrodes 46 thereon, and the opposite plate a glass faceplate 48 having a conductive layer 50 and a cathodoluminescent material deposited thereon. The potentials on the strip electrodes 46 and the conductive layer 50 are made equal, resulting in "practically an equipotential space" (quoted from column 3, lines 23-24 of the subject patent). The beams travel through the space 52 to a collector electrode 54. Reducing the voltage on a conductive strip causes the potential to become unequal and results in diversion of the beams toward the faceplate at the level of the strip, according to the disclosure. The device as shown would seem to lend itself to only the simplest of displays. Again, such a display would necessarily be small as the structure is not self-supporting.

U.S. Pat. No. 4,028,582 to Anderson et al discloses a guided beam flat display device. The device comprises an evacuated envelope having a rectangular display section. A gun section is located on one edge of the display section. The display section includes a front and a back wall which are generally rectangular and in closely spaced, parallel relation. A plurality of spaced support walls between the front and back walls form the plurality of parallel channels. The gun section includes a gun structure for directing electrons into the channels. A beam guide in each channel confines the electrons in a beam and guides the beam along the length of the channel. The electron beam can be selectively deflected out of the guide at selected points along the guide to impinge upon a phosphor screen. A scanning deflector in each of the channel deflects the path of the beam as it passes from the guide to the phosphor screen so that each of the beams scan a portion of the screen.

For a color display device, three beams of electrons are preferably directed into each of the channels. In addition to modulating and scanning electrodes, line-sampling electrodees are included in each channel to generate an electrical signal which can be detected. The line-sampling electrodes can be used to detect the position and/or the intensity of the current of the beams.

By having each beam scan transversely across the portion of the phosphor screen in each channel, it is alleged that the number of beams necessary to achieve a scanning of the entire width of the device is reduced. It is stated, for example, that for display device forty inches in width having channel which are one inch in width, only forty beams for black and white, and forty sets of three beams for color, are necessary. The electrons comprising each of the beams are caused to remain in their respective channels by slalom focusing.

A major object of Anderson et al appears to be an attempt to reduce structural complexity through a reduction in the number of columns--forty in the example cited and a corresponding reduction in the number of beams. However, it is believed that the achievement in columnar structural simplicity is counterbalanced by the greatly increased complexity in beam functions, and the consequent complexity and difficulty in proper beam control.

Also relevant for their showing of flat display devices having guided beams are German patent disclosures 26 38 308 and 26 38 309. The '308 patent disclosure is the German counterpart of an application to Credelle, Ser. No. 607,490 referenced by Anderson et al. In the '309 patent, Osborne discloses an electron-beam-address device of flat design having means for the propagation of beams through channels. One means comprises an outer conductive tube, a conducting rod which extends down the axis of the tube, and a "spiraling" electrode which causes a beam of electrons to follow a spiraling path around and down the rod. Another means disclosed is the aformentioned "slalom-focusing" wherein charged wires or rods are arranged in a common plane between two parallel grounded, or negatively charged, plates. An electrostatic field causes an electron beam to follow a wavy path through the arrangement of rods or wires. Means are also disclosed for deflecting the beams out of the channels. Slalom focusing is described in a journal article titled "Slalom-Focusing," by J. S. Cook et al, Proc. of the IRE, November 1957, pp. 1517–1522. An electron gun for slalom-focusing systems is disclosed in U.S. Pat. No. 2,939,034 to Cook et al.

U.S. Pat. No. 4,067,994—Anderson, discloses a flat display with beam guides having substantially the same basic panel structure as the aforedescribed 4,028,582—Anderson et al. Means for beam confinement comprise a great many quadrupole electrode configurations extending along the path of the beam, which provide for a simultaneous focusing and defocusing of the beam in different planes to confine the beam. As with the aforedescribed Anderson et al disclosure, beam -diverting is caused by a change in potential on a selected one of a series of row-wise conductive strips, one for each row of the display, coated on the back wall. The resemblance to the beamdiverting means disclosed by Charles in the aforedescribed U.S. Pat. No. 3,723,786 will be noted.

In summing up, it appears that attempts to apply electron-beam picture tube technology to a flat panel display have been largely frustrated by one or both of such factors as the screen-size limitation dictated by the difficulty of providing internal envelope support in regions of beam excursion, and the need to utilize a high-energy beam to get adequate phosphor excitation. This need in turn dictates that beam control and modulating voltages be correspondingly high and out of the practical realm of utilization of transistor and integrated circuit technology. Structural complexity is another factor that has inhibited the realization of practical panel displays.

Other Prior Art

U.S. Pat. Nos. 2,795,731 Aiken; 2,863,091, Epstein et al; 2,967,965, Schwartz; 2,858,464Roberts; 2,879,446, Aiken; 2,904,722, Aiken; 2,945,982, Foster; 2,961,575, Pohl; 2,978,601, Aiken; 3,005,127, Aiken; 3,177,127, Namordi et al; 3,181,027, Geer; 3,379,912, Shanafelt; 3,435,269 , Shanafelt; 3,461,333, Havn; 3,395,312, Freestone et al; 3,683,224, Lea; 3,904,923, Schwartz.

OBJECTS OF THE INVENTION

It is a primary object of this invention to provide a practical panel display activated by electron beams.

It is another object of this invention to provide an electron beam panel display whose envelope is self-supporting, and wherein the size of the display area is not limited by factors such as atmospheric pressure.

It is a less general object to provide an electron beam panel display capable of television picture reproduction fully compatible with NTSC standards.

It is an object to provide an electron beam panel display system that can utilize to the fullest the proven technology of the television cathode-ray picture tube system, such as phosphor and high vacuum technology.

it is another object of this invention to provide relatively non-complex structural means for channeling and diverting electron beams in panel displays.

It is a specific object to provide an electron beam panel display generating guided low-energy beams that can be propagated, controlled, modulated and diverted by relatively low potentials so as to use to the fullest the present-day technology of transistors and integrated circuits.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the acompanying drawings in which;

DESCRIPTION OF THE PREFERRED EMBODIMENTS

For thorough understanding of the present invention, together with other further objects, advantages and capabilities thereof, reference is made to the following specification and claims in connection with the aforedescribed drawings.

Figure 1:
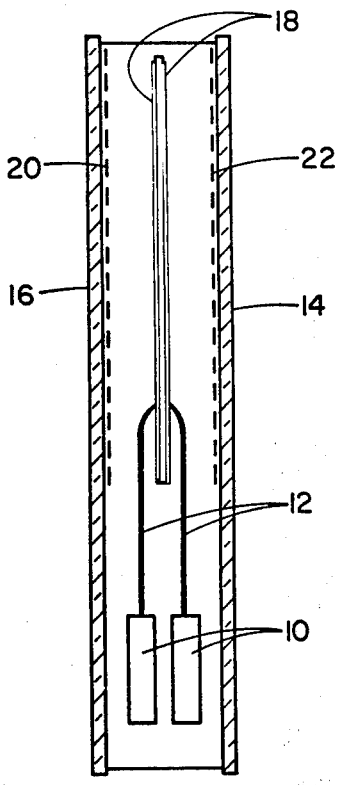
Fig. 1 PRIOR ART
FIGS. 1, 2 and 3 illustrate in highly schematic form prior art flat panel image display devices utilizing electron beams.
Figure 2:
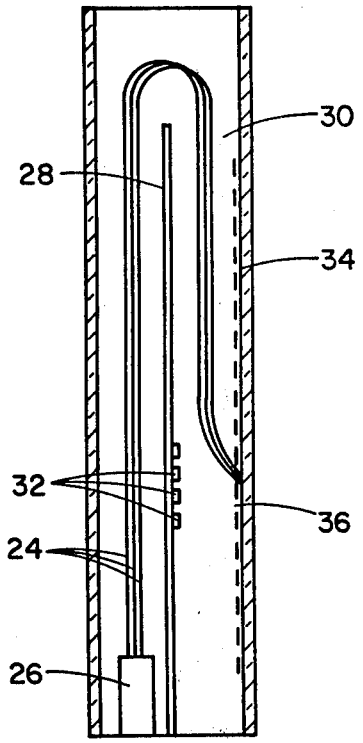
Fig. 2 PRIOR ART
Figure 3:
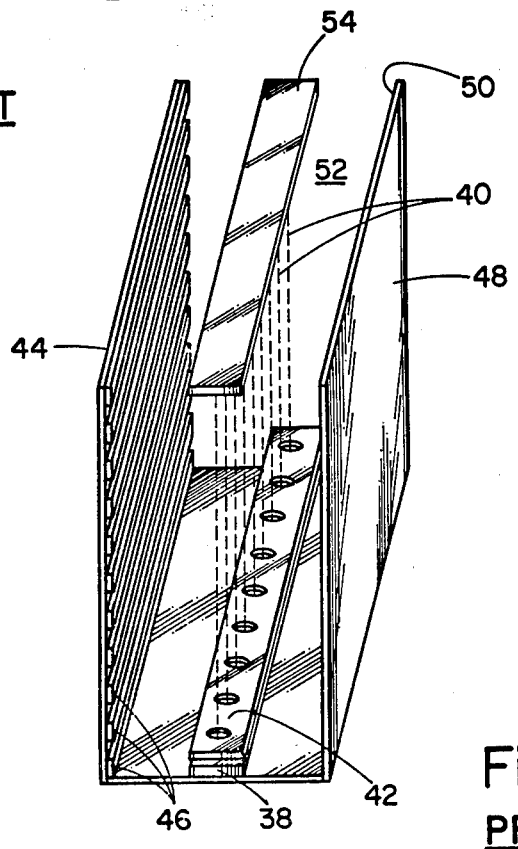
Fig. 3 PRIOR ART
Figure 4:
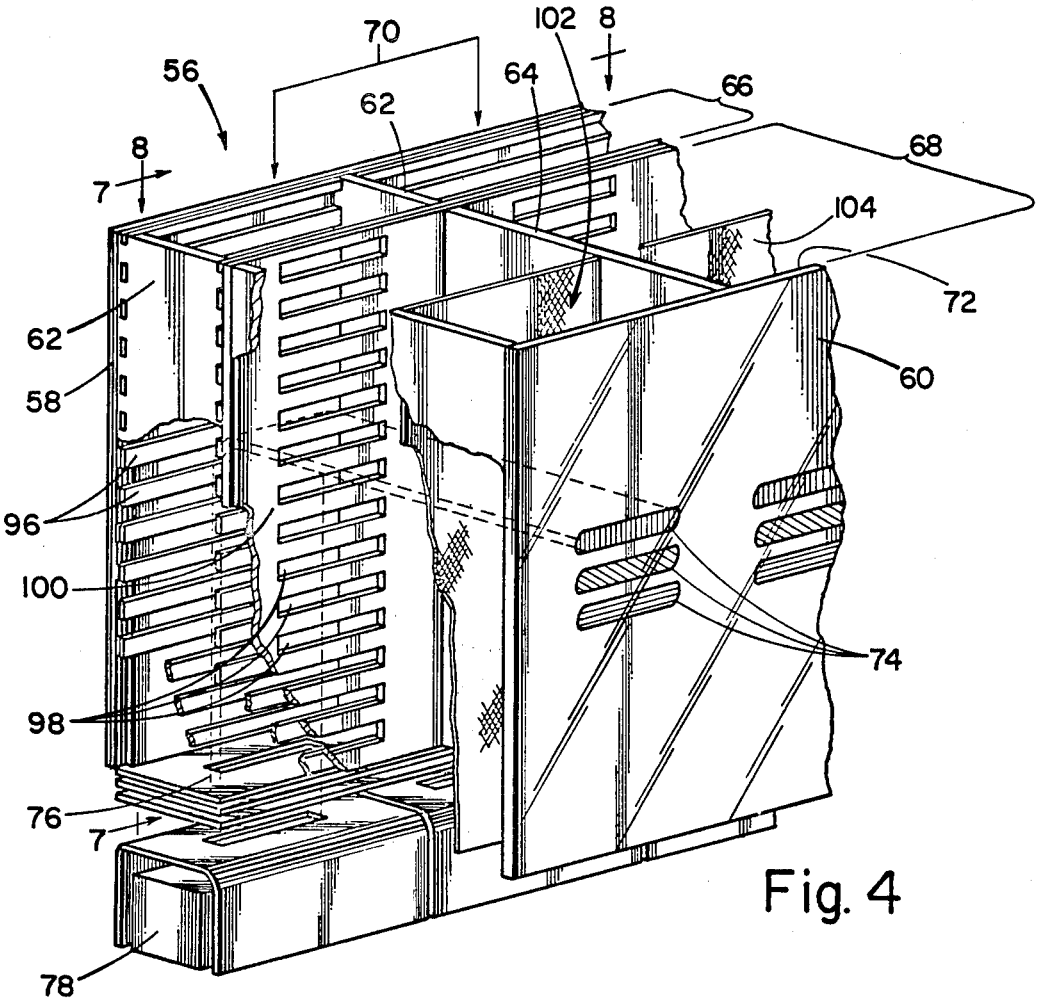
FIG. 4 is a highly schematic fragmentary view in perspective of a cathodoluminescent panel display constructed in accordance with the principles of this invention.

There is shown in FIG. 4 a section of an image display panel 56 having a backwall 58 and a faceplate 60 which comprise the back and front members of standard flat panel configuration well-known in the art. The complete structure comprises an evacuated, self-supporting envelope, with said support supplied by a succession of back-to-front extending side plates 62, each of which abuts upon a vertically extending spacer 64. The internal, bridging support supplied by side plates 62 and vertically extending spacers 64, which are in close adjacency throughout the panel, makes it possible for panel 56 to support the immense force of the atmosphere upon back wall 58 and faceplate 60. In a panel display having a 50-inch diagonal measure, for example, the force of the atmosphere upon the evacuated envelope approaches eighteen tons; that is, nine tons per side.

Panel 56 is shown as being partitioned into two distinct sections comprising a low-voltage rear section 66 and a high-voltage front section 68. The high-voltage front section 68 preferably comprises a faceplate 60 having an anode 72 which receives a relatively high voltage; that is, a voltage in the range of kilovolts. The low voltage rear section 66 is shown as being located contiguous to back wall 58 and comprises a column-wise succession of beam guide-isolators 70 disposed along the entire width of the panel. The number of such beam guide-isolators 70 may preferably be 500 in a typical panel. According to this invention, however, there may be a greater or lesser number depending upon specific panel configuration requirements.

The progression of an electron beam 76 according to this invention from the electron source 78 to its point of impingement on at least one phosphor target 74 on faceplate 60 will now be described. Electron source 78, which is shown as a monolithic structure disposed along a row-wise edge of panel 56, comprises a source of electrons for all of the electron beams guided by the succession of beam guide-isolators 70. Electron source 78 is shown as being disposed at the bottom edge of the panel; it could as well be at the top edge.

Figure 5:
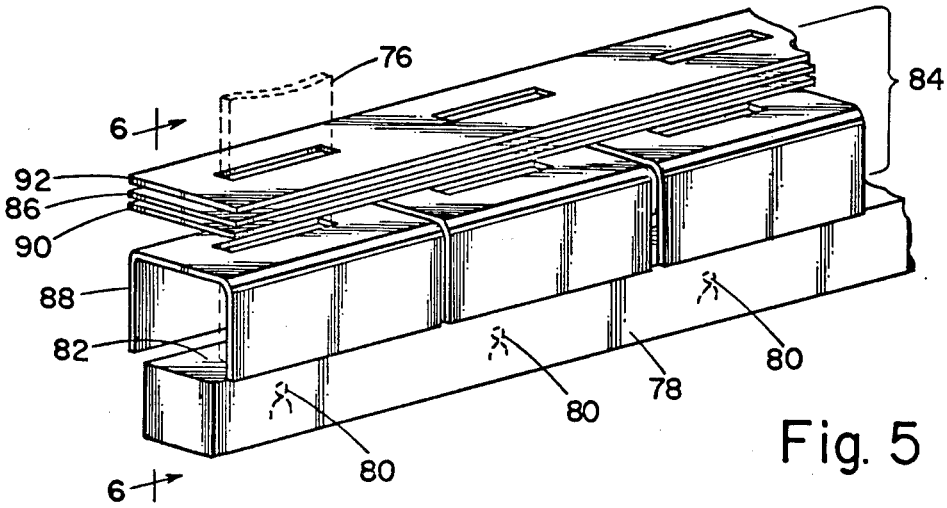
FIG. 5 shows in greater detail in perspective the electron source and grid sections shown by FIG. 4.
Figure 6:
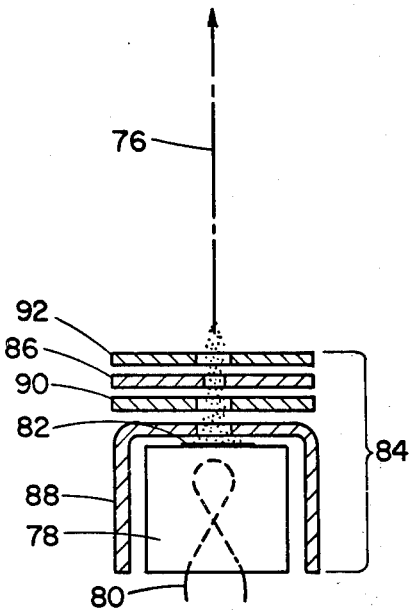
FIG. 6 is a side view in section of the electron source and grid means taken along lines 6—6 of FIG. 5.
Figure 7:
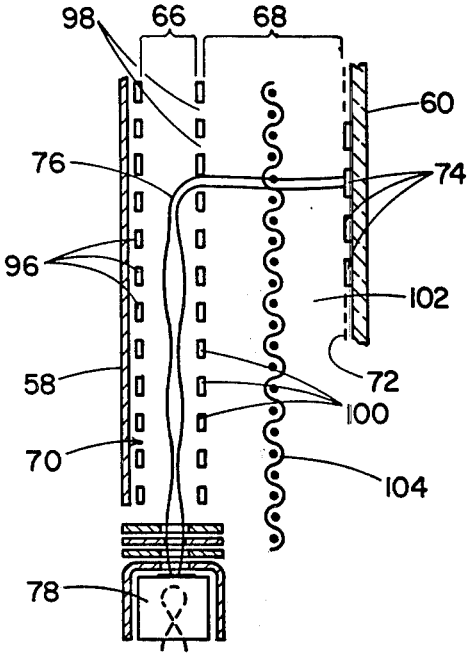
FIG. 7 is a side view in section taken along lines 7—7 of FIG. 4, showing in highly schematic form the guidance and diversion of an electron beam in a beam guideisolator structure designed to implement the teachings of this invention.

Referring additionally now to FIGS. 5, 6 and 7, electron source 78 may be energized by a single element or a plurality of resistive heater elements 80 therein embedded. The heating of electron source 78 results in turn in the heating of a thermionic material 82 disposed on a top surface of electron source 78, causing the emission of electrons from electron source 78 to form electron beam 76. This material may comprises any of a number of well-known thermionic emission compounds.

Electron beam 76 is then shaped and modulated by a sequential series of grid means 84 interspersed with at least one baffle means 86. The functions of the several grid means 84 and baffle means 86 will be dealt with in greater detail further on in this disclosure; however, a general description is supplied at this point to provide an overall understanding of the operation of the preferred embodiment of this invention as shown and described.

Modulation grid 88 initiates the segregating and collimating of electrons emitted by thermionic material 82 into a substantially rectangular beam form shown by the figures. Because of its contiguity to electron source 78, a time-varying signal applied to modulation grid 88 can be of a relatively low voltage. There is a separate, electrically discrete modulation grid 88 for each beam. Following in succession are unitary row-wise-extending accelerating means comprising at least one grid 90, and row-wise-extending decelerating means comprising at least one grid 92, interspersed with at least one baffle 86. Each of the grids represented schematically by 90 and 92 in FIGS. 5 and 6 may actually comprise of a plural number of grids rather than the single grids shown for initial expository purposes.

Upon emergence from decelerating grids 92, electron beam 76 having been modulated, and formed and shaped as shown, enters beam guide-isolator 70. Beam guide-isolator 70 directs the beam perpendicular to the edge of panel 56 and parallel to faceplate 60, providing a vertically propagated beam. Electron beam 76 is preferably a relatively low-energy electron beam; that is, a beam having an energy in the range of a few tens of electron volts, or potentials may be in the range of a few hundreds of electron volts. During its passage through beam guide-isolator 70, electron beam 76 is preferably subjected to a repetitive succession of higher and lower focusing and refocusing voltages, preferably substantially periodic, to prevent the electrons comprising the beam from leaving or striking beam guide-isolator 70.

In FIGS. 4 and 7, electron beam 76 is shown as being sharply diverted from a selected precise position opposite faceplate 60 by the application of a relatively low applied beam diverting voltage in the range of a few tens to hundreds of volts applied to one of a plurality of row-wise extending conductive strips 96. Electron beam 76 emerges from beam guide-isolator 70 through one of a plurality of apertures 98 in a ladder electrode 100, shown in highly schematic form in FIG. 4, and in greater detail in FIG. 11.

Upon emerging from one of said apertures 98, electron beam 76 enters high-gradient field area 102, whereupon the electrons of electron beam 76 are accelerated to a high energy to activate at least one of a pattern of cathodoluminescent phosphor targets 74 located on an inner surface of faceplate 60. In passage through the high-voltage front section 68 and its high-gradient field area 102, the velocity of the electrons comprising beam 76 are accelerated by the relatively high potential of anode 72. This potential may, for example, be in the range of 800 to 10,000 volts. These values, however, are not limiting. The impact of this high energy beam upon a phosphor target 74 provides a very bright emission from the phosphor target.

Figure 8:
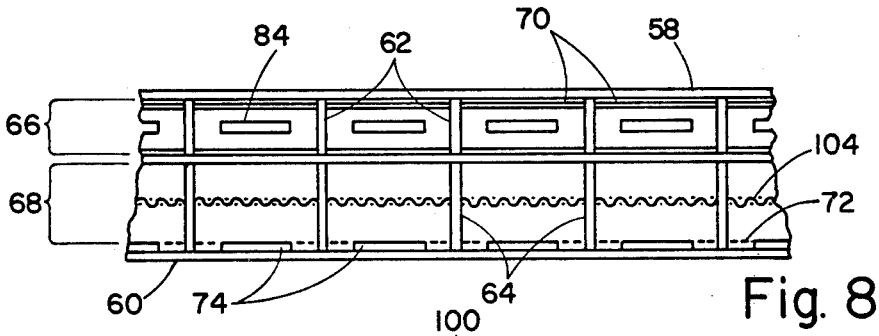
FIG. 8 is an enlarged fragmentary sectional view taken along lines 8—8 of FIG. 4 showing a succession of beam guide-isolators.

FIG. 8 provides a further illustration of the preferred embodiment, showing a top view of the structure. As will be clearly seen again in this view, the panel is partitioned into two distinct sections — a low-voltage rear section 66 and a high-voltage front section 68. This partitioning makes possible the generation of an electron beam having very low energy which can be propagated, controlled, shaped, modulated and diverted by relatively low potentials so as to be able to use to the fullest the present-day technology of transistors and integrated circuits. However, a beam of such low energy is by its nature ineffectual in activating a phosphor target to adequate brightness; hence, the relevance of the second distinct section that represents an aspect of the preferred embodiment of this invention — the high-voltage front section 68. This high voltage front section imparts to the beam the high energy necessary for the bright illumination of the phosphor targets.

Although beam guide-isolator 70 provides for effective containment of the electron beam by means of the aforesaid repetitive and substantially periodic focusing and refocusing, it may be preferable to provide further isolation between the low-voltage rear section 66 and highvoltage front section 68. The propinquity of the beam guideisolator 70 located in low voltage rear section 66 to highvoltage anode 72 on faceplate 60 constitutes an inducement for the electrons in beam 76 to leave beam guide-isolator 70 and travel through high gradient field area 102 to anode 72. The distance between electron beam 76 and anode 72 may be, for example, less than one-half inch. Any electrons straying from beam 76 and randomly impinging upon phosphor target 74 may produce a diffused glow on faceplate 60, resulting in a reduction of image contrast. In actuality, the structure of the preferred embodiment of the beam guide-isolator 70 as shown, which provides for a repetitive focusing and refocusing of the electron beam, and preferably substantially periodic, markedly inhibits the escape of electrons from electron beam 76.

However, it may be beneficial to install an electron-transmissive screen 104 disposed between the beam guide-isolator 70 and faceplate 60. The purpose of screen 104, which has a nominal potential of, for example, several hundred volts, is two-fold; (1) to present to electron beam 76 a relatively controllable field, one which does not upset the constraining forces on the beam passing through beam guide-isolator 70, and one providing an initial, relatively mild electron acceleration, and (2), to isolate the electron accelerating high gradient field of high-voltage front section 68 from low-voltage rear section 66.

Figure 9A:
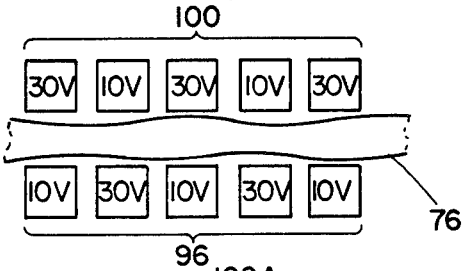
FIGS. 9A and 9B show in highly simplified block form alternate electrode potentials and shapes according to this invention.
Figure 9B:
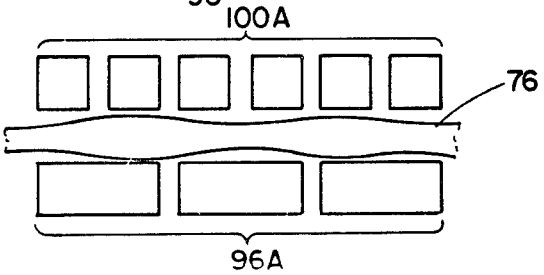
Figure 9:
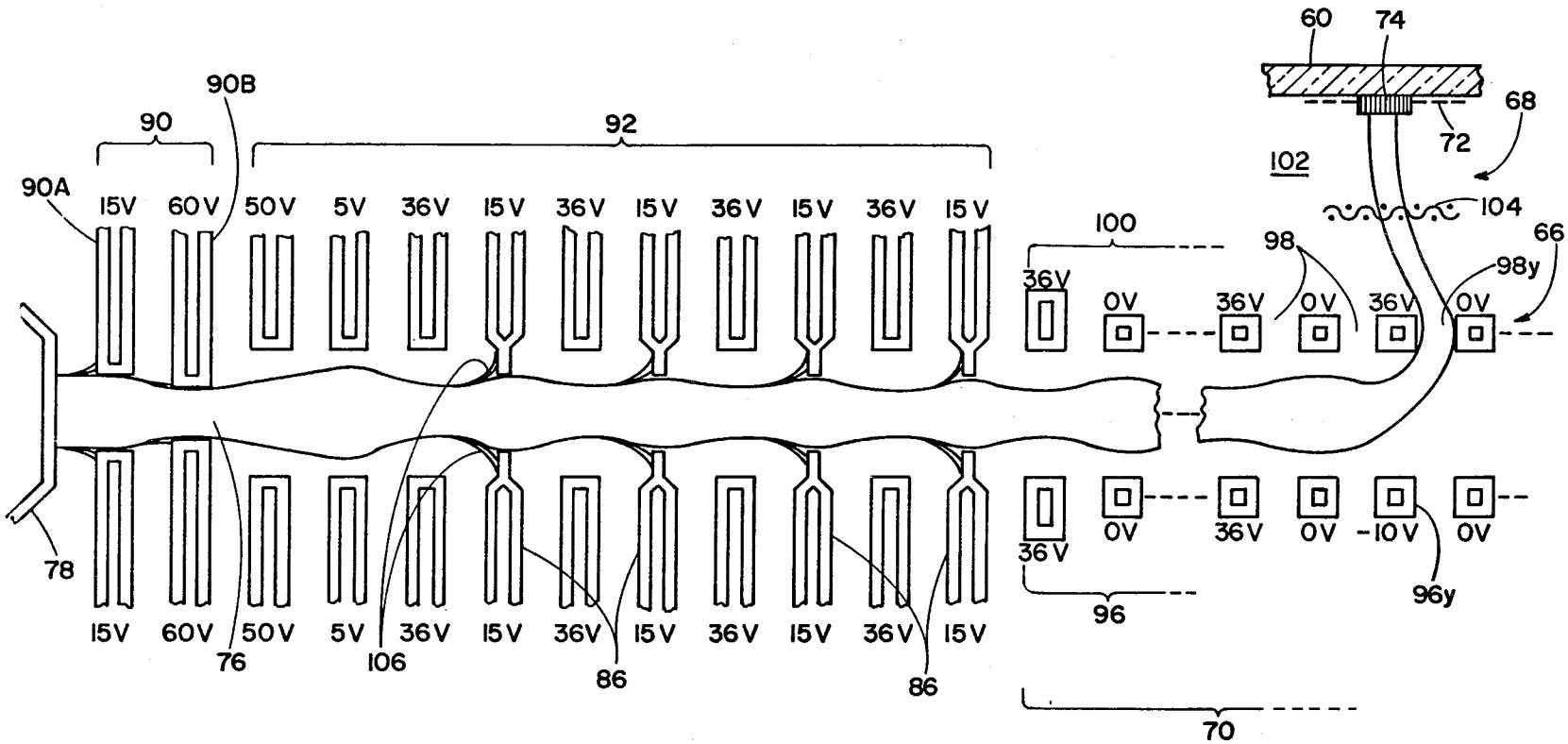
FIG. 9 is a computer plot showing the excursion of an electron beam according to this invention from an electron source to a phosphor target.

FIG. 9 is a computer plot showing the progression of an electron beam 76 from electron source 78 through an accelerating means 90 and decelerating means 92, followed by entry of the beam into beam guide-isolator 70, and the diversion of the beam through one of a plurality of ladder apertures 98 to a point of impingement on phosphor target 74. This structural aspect of the preferred embodiment of this inventon fulfills the objective of providing an electron beam having a low-energy level responsive to low beam-directing, modulating, and diverting voltages. However, to achieve the equally important objective of an adequate brightness level of the display, the electron beam must reach its phosphor target with sufficient energy to adequately excite the phosphor to the desired brightness level. These objectives are accomplished by the FIG. 9 structure which represents a preferred embodiment of this invention, as will be shown.

The potentials on each of the succession of grids of accelerating means 90, decelerating means 92 and the individual electrodes comprising ladder electrode 100 are shown in relation to each grid; that is, from left to right, fifteen volts, sixty volts, fifty volts, etc. These values are not necessarily limiting, but may be relatively higher or lower and of different sequence to achieve the objective of an electron beam 76 responsive to relatively low potentials.

It will be noted that accelerating means 90 comprises a first grid 90A, and a second grid 90B which is an accelerating grid having thereon a relatively higher potential of, for example, sixty volts, for drawing from electron source 78 a desired electron density and accelerating the electrons. However, this drawing from, and accelerating of, electrons from electron source 78 also imparts to electron beam 76 an undesired higher energy level inconsonant with the objective of a low-energy beam. So the accelerating means 90 is followed in sequence by a decelerating means 92, comprising at least one decelerating grid. The values noted supra to each of decelerating grids of decelerating means 92 in FIG. 9 represent voltages that initiate the repetitive focusing and refocusing, preferably periodic according to the preferred embodiment, of electron beam 76 that is typical in the travel of the beam in its entire passage through beam guide isolator 70. As is well-known in the art, an electron beam, when subjected to a decelerating potential, tends to expand. One result of this expansion is the undesired emission of aberrant electrons from the main path of the beam as shown by 106. If allowed to travel unintercepted, these aberrant electrons 106 could randomly reach the phosphor targets located at the lower section of faceplate 60 to cause a diffused glow on the faceplate. A series of baffle means 86 having beam-passing apertures smaller than the associated grid apertures may be provided to intercept aberrant electrons 106 in their path outside the main path of electron beam 76.

As a result of its passage through accelerating means 90 and decelerating means 92, electron beam 76 now displays the desired characteristics of being repetitively and substantially periodically focused, devoid of aberrant electrons, and responsive to relatively low beam-control voltages.

Electron beam 76 emerges from accelerating and decelerating means 90 and 92 to enter beam guide-isolator 70. As shown by FIG. 9, the opposed pairs of the electrodes comprising ladder electrode 100, and the electrodes comprising the ladder-like conductive strips 96, are shown as having a preferably identical potential thereon so that the different potentials along beam guide isolator 70 preferably impose upon the beam a substantially periodic succession of higher and lower focusing and refocusing voltages to prevent the electrons that comprise the beams from leaving beam guideisolator 70.

The side plates 62 shown by FIG. 8, further define the beam channel. The potential on side plates 62 is preferably fixed to supply a constant force to electron beam 76, in contrast to the repetitive and substantially periodically varying force applied by ladder electrodes 100 and conductive strips 96. In essence, the walls of beam guide isolator 70 are devised to direct the electrons comprising the beam away from the walls and through the central region of the beam channel.

The progression of the beam through beam guideisolator 70 perpendicular to the edge of the panel and parallel to faceplate 60 continues to the desired point of diversion of electron beam 76 from beam guide isolator 70. The point of diversion shown by FIG. 9 is opposite conductive strip 96y to which has been applied a potential of, for example, minus ten volts. This beam diverting voltage sharply diverts electron beam 76, causing it to emerge from ladder aperture 98y. The beam so diverted towards faceplate 60 enters high gradient field area 102 where it is accelerated to a high energy to activate phosphor target 74.

The partitioning of the preferred embodiment of this structure into two distinct sections is again clearly shown by FIG. 9, wherein the panel structure comprises a high-voltage front section 66 and a low-voltage rear section 68. The electron transmissive screen 104, which is disposed between beam guide-isolator 70 and faceplate 60, performs the functions specified in the foregoing.

Figure 10:
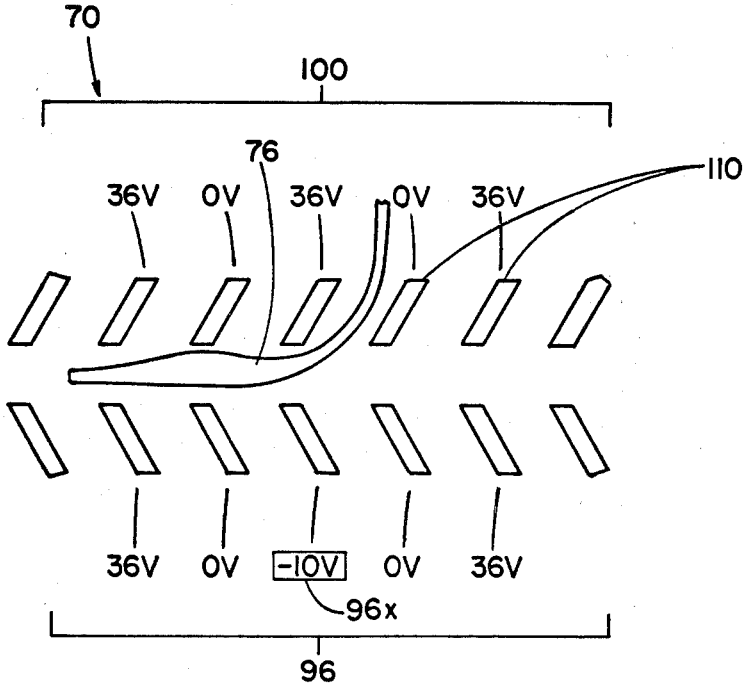
FIG. 10 is a computer plot showing the path of an electron beam as diverted from a beam guide-isolator according to this invention wherein electrodes are angled forwardly and outwardly.

The fingers of ladder electrode 100, and conductive strips 96, are shown by FIG. 9 as being aligned orthogonally to the line of travel of electron beam 76. An alternative embodiment of the beam-diverting structure is shown by FIG. 10, wherein the electrodes 110 comprising the ladder electrode and conductive strips are angled outwardly and forwardly relative to the line of beam travel to facilitate diversion of the beam from beam guide-isolator 70 and to provide isolation of the propagated beam 76 from the forces of the high gradient field 102. The diversion of electron beam 76 from beam guide isolator 70 is shown as being accomplished by a change of potential of electrode 96x to a value of, for example, minus ten volts.

Figure 11:
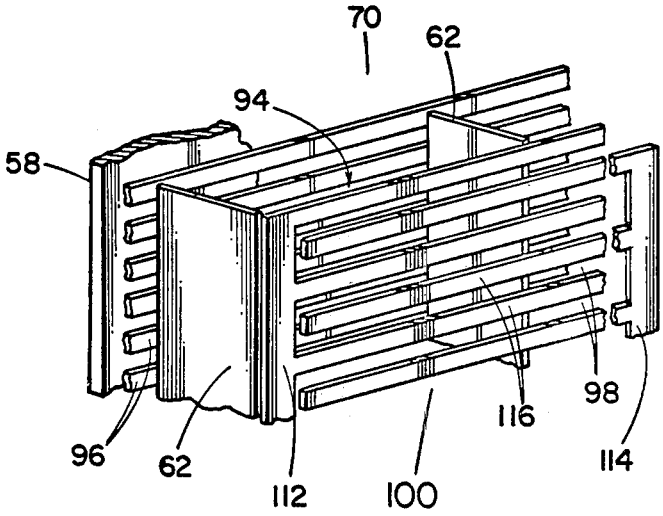
FIG. 11 is a fragmentary perspective view showing components of a beam guide-isolator constructed in accordance with the principles of this invention.

In the foregoing, the structure of beam guideisolator 70 has been shown in simplified form to facilitate understanding of the preferred embodiment of the invention. FIG. 11 shows the structure that represents the preferred embodiment of beam guide-isolator 70 in great detail. As noted, a plural number of beam guide-isolators 70 extend column-wise across the full width of the panel to provide channels for a plural number of electron beams, one for each beam. These beam guide-isolators extend to the full height of display panel 56 to provide access of the plurality of electron beams to the entire imaging area of the panel 56.

The beam channel 94 of beam guide-isolator 70 shown in the preferred embodiment by FIG. 11 comprises two spaced, facing ladder-like electrodes, the front one, nearest the faceplate, being ladder electrode 100. A second ladder-like electrode comprises a series of discrete row-wise conductive strips 96 located nearest back wall 58. Ladder electrode 100 comprises two electrically discrete comb-like members 112 and 114, the fingers 116 of which are interdigitated with apertures therebetween and which extend row-wise across the entire width of the panel.

Each of the discrete, row-wise conductive strips 96 is shown as lying parallel with and opposed to one of fingers 116. Each of the comb-like members 112 and 114 preferably has a different potential thereon, and each of the discrete conductive strips 96 opposed to one of said fingers generally may have similar potentials thereon. Beam channel 94 may be further enclosed by the two electrically discrete conductive side plates 62 to define the channel for guiding the electron beam 76.

The side plates 62 are preferably operated at a relatively low potential, for example, plus five volts, which is generally below the average value applied to the fingers 116 of ladder electrode 100. This potential serves to repel the beam from the immediate vicinity of side plates 62, thus constricting the beam inwardly from the sides and causing it to be propagated through the central region of beam guideisolator 70.

Each strip-and-finger combination also may preferably have an identical potential thereon so that the different potentials along beam guide isolator 70 may impose upon the electron beam a repetitive and preferably a substantially periodic succession of focusing and refocusing voltages applied by each strip-and-finger combination to constrain the electrons comprising the beam from leaving beam guide-isolator 70. Electron beam 76 is shown in FIG. 9 as being diverted from beam guide-isolator 70 by altering the potential on a selected one of the conductive strips 96 to cause beam 76 to be sharply diverted from beam guide-isolator 70 through one of a plurality of ladder apertures 98 toward faceplate 60 and associated anode 72.

As described in the foregoing, and as illustrated by fig. 9, the potentials on opposed ones of accelerating grids 90, decelerating grids 92 and each strip-and-finger combination are shown as being identical for exemplary purposes. This allotment of potentials is not so limited, and it is within the scope of this invention to provide for the directing, shaping and propagation of electron beams by means of other values and the sequence of their application. For example, the electrodes having similar functions may be electrically correlated, as shown by FIG. 9, or in staggered paired potential as shown by FIG. 9A.

Neither is the configuration of the structure as shown and described of necessity for the functioning of the invention, as structural parts and their relationships can also be varied. For example, repetitive and substantially periodic focusing and refocusing fields are illustrated in FIG. 9 as being applied to electron beam 76 by the ladder electrodes 100 and conductive strips 96. The side plates 62 illustrated in FIG. 4 could as well be ladder-like according to this invention and similarly impose a repetitive, but substantially periodic focusing and refocusing field upon beam 76. Also, it is entirely feasible that only one wall of the four walls that comprise beam guide-isolator 70 be devised so as to apply such focusing and refocusing fields to the beam; the other three walls could as well have a constant potential thereon. Neither is it necessary, as shown by FIG. 9B, that the conductive strip electrodes 96A be identical in size and shape to the opposed electrodes 100A of ladder electrode 100.

Figure 12:
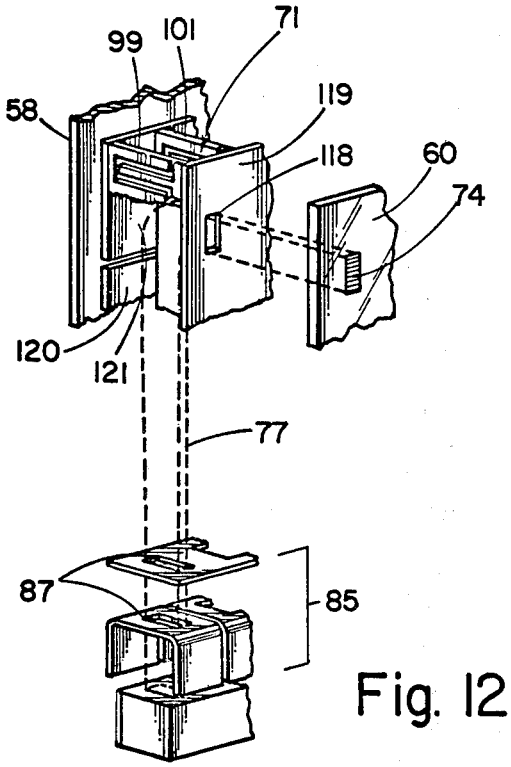
FIG. 12 is a fragmentary perspective view showing an electron beam diverted through an aperture in the side plate of a beam guide-isolator.

Another embodiment of the invention is shown by FIG. 12 wherein the entire beam guide-isolator is reoriented in effect by rotating the beam guide-isolator ninety degrees. It will be seen that one of the aforedescribed side plates 62 now faces faceplate 60, while the opposite side plate now lies in the place of one of the aforedescribed conductive strips 96. In this embodiment, the electron beam 77 emerges through (the now) front plate 119 through aperture 118. Two ladder electrodes 99 and 101 are now in the former place of the end plates, and provide the same function of repetitively and preferably periodically focusing and refocusing electron beam 77 to constrain the electrons comprising beam 77 from leaving beam guide-isolator 71. In this alternative embodiment, each backplate 120 and 121 extends row-wise and takes over the function of one row of the discrete row-wise conductive strips 96, and is similarly located contiguous to back wall 58. A change in the potential on backplate 121 from a nominal plus five volts to minus five volts, for example, causes the diversion of beam 77 from beam guide-isolator 71 through aperture 118 from the selected precise position opposite faceplate 60 to activate phosphor target 74. Since the backplates are row-wise extending, a change in potential of a backplate will result in a deflection of all beams on the level of the backplate.

In this embodiment, the several grids 85 must be modified to reflect the ninety-degree re-orientation of beam guide-isolator 71, as will be noted in the illustration. For example, slots 87 in grids 85 are shown as being rotated in orientation ninety degrees.

As noted in the foregoing, the electron beam cathodoluminescent panel display that is the subject of this disclosure is particularly suitable for the display of television pictures. It is also useful for other image displays such as alphanumeric, computer and computer graphics. The following description is concerned primarily with the display of color television pictures.

Figure 13:
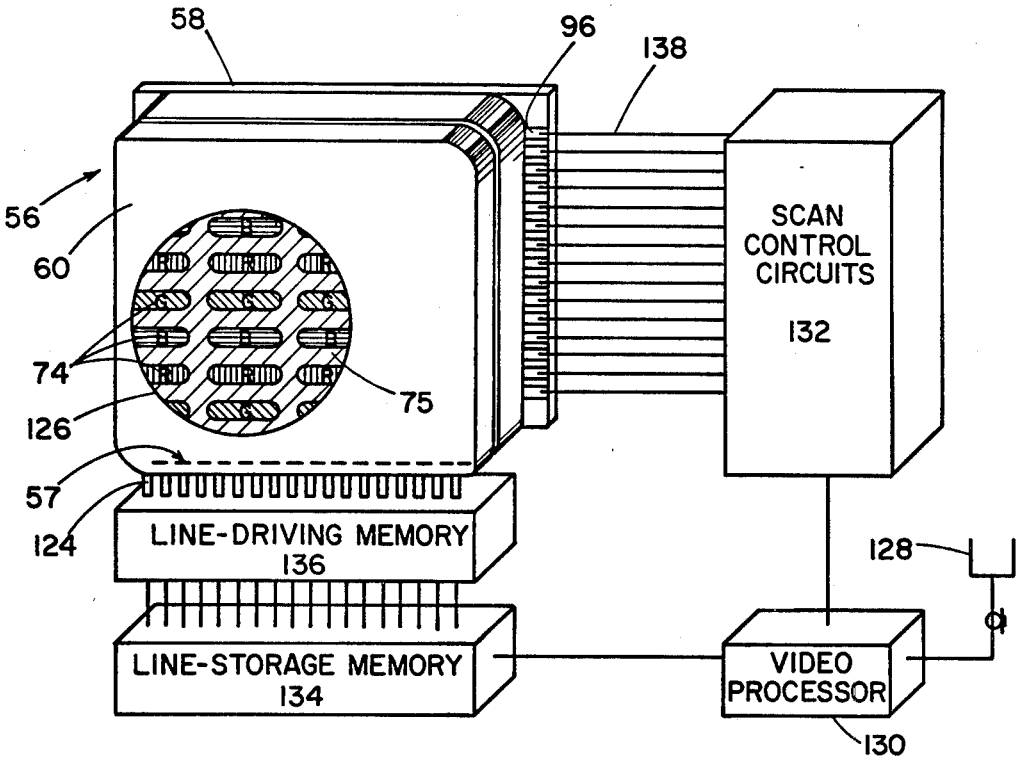
FIG. 13 shows in highly schematic form a television panel display according to this invention utilizing ancillary video processing and scanning components.

The ancillary components and connections required for the adaptation of panel display 56 to the requirements of color picture reproduction are shown in highly schematic form in FIG. 13. Display panel 56 comprises the structure of the preferred embodiment of the invention described in the foregoing. The major components involved in television picture reproduction according to this invention are shown; namely, a faceplate 60, a back wall 58, conductive strips 96, and conductors 124 that lead to modulation grids 88. Grids 88 (not shown) are represented as being disposed along a line 57 of panel 56 behind faceplate 60. Section 126 on faceplate 60 represents an enlargement of a small area of faceplate 60 showing in detail the cathodoluminescent phosphor targets 74 which comprise rows of alternating red, green and blue picture elements arranged in rows and columns as shown. It will be recalled that there is one discrete conductive strip 96 for control of one discrete row of phosphor targets 74, and one discrete modulation grid 88 for control of each discrete column of phosphor targets 74 vertically propagated through beam guide-isolators 70 (not shown).

To enhance color purity, contrast, and to reduce front reflection, the phosphor targets 74 may be surrounded with a light-absorptive material 75 as is well-known to the art.

Ancillary circuits required for processing of the color television signal, and scanning and modulation of the electron beams that activate phosphor targets 74 to provide a modulated raster scan, may include video processor 130, scan control circuits 132, line storage memory 134, and line driving memory 136. The four ancillary circuits 130-136 may be constructed according to principles well-known to those skilled in the art.

In operation, antenna 128 receives an over-the-air television picture broadcast signal. This is a composite signal comprising discrete chrominance, luminance, and synchronization signals. The signal is processed in video processor 130, which separates the composite signal into the discrete signals recited supra. The information comprising the red, green and blue signals derived from chrominance and luminance signals is stored line-by-line in line-storage memory 134. This information is then transferred in parallel to the line driving memory 136, and the line-storage memory 134 is erased to accept the next line's worth of information from video processor 130. While the next line of information is being stored, driving memory 136 provides color information signals through conductors 134 to drive the discrete modulation grids 88 located within the panel along line 57. One grid is provided for modulating each column of electron beams as described in the foregoing. These modulating signals provide for the control of the hue, chroma and intensity of each line of phosphor targets 74 displayed on panel 56.

Video processor 130 also provides synchronization signals derived from the composite signal to the scan control circuits 132. Conductors 138 electrically link the output of the scan control circuits 132 to the plurality of row-wise extending conductive strips 96. In response to synchronizing signals received from video processor 130, scan control circuits 132 selectively and sequentially change the potential on each of said conductive strips 96 usually in a top-to-bottom direction to provide a sharp, simultaneous diversion of the column-wise extending beams from the beam guide-isolators 70 toward faceplate 60, as heretofore described.

By the means described; that is, the sharp, simultaneous diversion of all of the electron beams upon reaching a selected row, image display panel 56 can be scanned at television scan rates according to NTSC standards. The type of scanning can be the standard interlaced type; that is, scanning one field of even lines from top to bottom, then scanning the other field of odd lines from top to bottom at a scanning rate of sixty fields per second to provide thirty complete frames per second.

Figure 14:
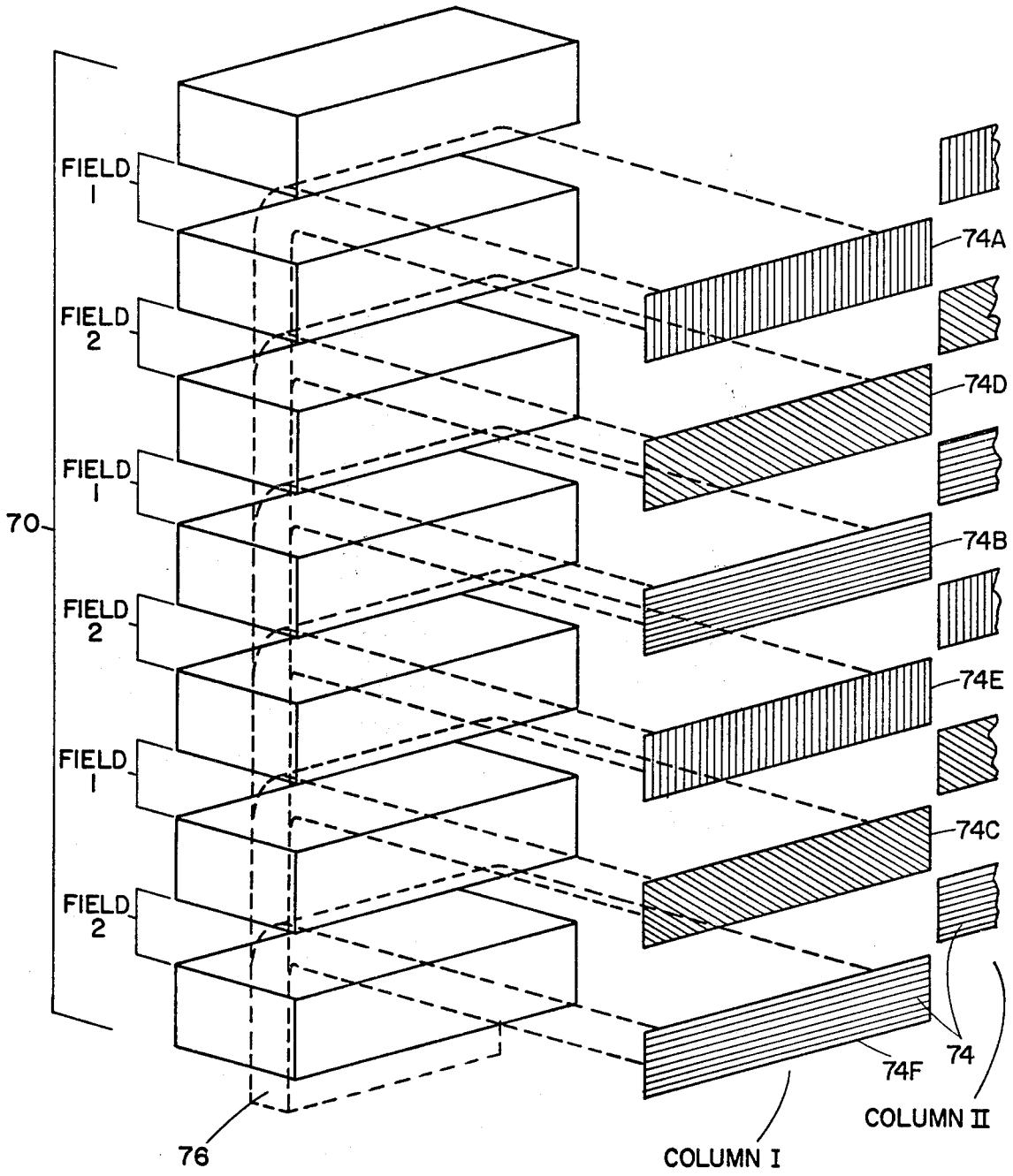
FIG. 14 is a greatly simplified schematic diagram in perspective showing scanning in relation to beam guideisolators and correlative phosphor targets in accordance with this invention.

A modification of the simple scanning procedure described in the foregoing is required for the proper display of color television pictures. A suitable modification, which represents a preferred embodiment, is provided by the scanning means shown by FIG. 14. The components shown by FIG. 14 are in highly schematic form, but they will be readily recognized as beam guide-isolator 70 and electron beam 76. Phosphor targets 74 are shown in two columns; column I targets are designated 74A–F. The rows of phosphor targets are addressed as described in the following.

During one field of scan, electron beam 76 of column I may issue from a top one of one of a series of bracketed apertures denoted as "field 1" in the illustration, then successively illuminate red phosphor target 74A, blue phosphor target 74B and green phosphor target 74C. Accomplishment of this triple scanning within the time of a single monochrome line requires that each line of targets 74A, 74B and 74C be scanned at a frequency of 3H, or, one-third the normal scanning time for one line, so each line is illuminated for a period of approximately fifteen to twenty microseconds. ( "h" is the well-known constant equivalent to 63.5 microseconds.) This scanning sequence continues from top to bottom of the display panel until the entire field 1 has been scanned. Then the field 2 apertures are scanned in sequence in a like manner; e.g., phosphor target 74D, 74E and 74F are illuminated successively at a frequency of 3h until the entire field 2 has been scanned, thus completing the scanning of one entire frame.

As each beam illuminates a phosphor target in its column, it is modulated with suitable chrominance and luminance information supplied by the line-storage memory 134 and line-driving memory 136.

To provide diversity of phosphor pattern, alternate columns of the beam guide-isolators may preferably be offset vertically a distance equal to one and one-half the center-to-center distance between the rows, together with their correlative phosphor targets. This offsetting will be seen by a comparison of the relative horizontal levels of the phosphor targets 74 comprising column I and column II in FIG. 14.

The structure representing the preferred embodiment of this invention as described in the foregoing lends itself equally well to the display of monochrome television images. To provide for a solely monochrome display, the color television picture display system shown by figure 13 and described in the foregoing would be modified as follows: Scan control circuit 132 would operate at frequency h rather than $3h$ and only one-third as many beam ladder electrodes would be needed. The inner surface of faceplate 60 can be covered with a homogeneous coating of monochrome phosphor material. Video processor circuit 130 can be simplified in that it would be necessary to supply only luminance information to line-storage memory 134.

The preferred embodiment of the invention as described lends itself equally well to the display of images other than television such as alphanumeric, computer and computer graphics.

In the preferred embodiment described in the foregoing, a monolithic thermionic cathode is described. The supplying of electrons by thermionic means is a major factor in energy consumption, so there is incentive to search for more energy-efficient sources such as field emission or other efficient means.

With regard to dimensions and the structural relationships of the illustrated preferred embodiment, these factors are in conformance with NTSC standards for the imaging of television pictures. The dimensions of the phosphor targets 74 may be, by way of example, 20 mils high and 60 mils wide, providing a picture element small enough so as not to be distinguishable at normal viewing distance. Further, in conformance with NTSC broadcast standards, the display area of faceplate 60 may encompass about four hundred and fifty lines of tri-color picture elements (1350 color lines) and five hundred columns, each column of which would comprise a discrete beam guide-isolator 70. All dimensions depend, of course, upon ultimate screen size, and the structural components may be scaled down or up accordingly in a manner well-known to those skilled in the art.

With regard to phosphor composition, standard television cathode ray tube phosphors may be used in the preferred embodiment of the invention as disclosed. Continuing research in phosphor technology will eventually result in phosphors which are highly efficient at lower screen voltages; that is, anode voltages in the range of one to five kilovolts. Zinc oxide is a present example of such an efficient low-voltage phosphor. Although the embodiment of the invention disclosed herein will function effectively with phosphors requiring relatively higher voltages; that is, in the range of five to fifteen kilovolts, the availability of more efficient, lowvoltage phosphors would be advantageous in view of the lower display panel voltage requirements.

With regard to component construction, well-known techniques such as photo-etching or shaping and cutting by laser, can be utilized for fabrication of intricate parts such as the ladder electrodes. Tolerances of these electrodes and the other parts comprising the beam guide-isolator must be in the range of a few mils, departures of the surface from an ideal plane being particularly undesirable.

It must be recognized that changes may be made in the aforedescribed apparatus without departing from the true spirit and scope of the invention herein involved. For example, the beam-guiding and beam-diverting means according to the principles of the invention may comprise the configurations shown by FIGS. 15–19.

Figure 15:
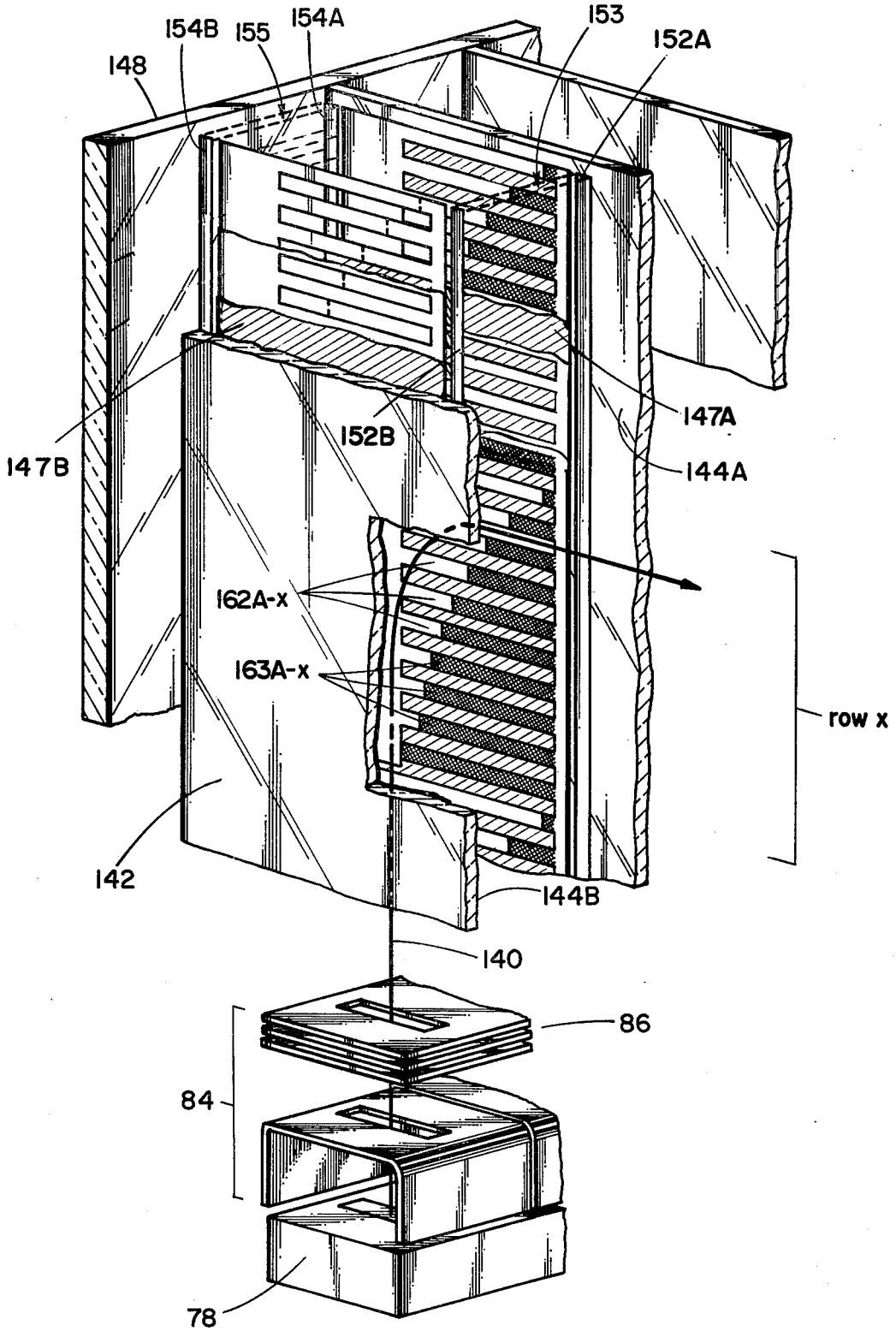
FIG. 15 is a highly schematic fragmentary view in perspective of another embodiment of the invention.

With reference first to FIG. 15, there is shown a highly schematic fragmentary view of a display panel comprising another aspect of the invention including an electron source means 78, and grid means 84 including baffle means 86; these electrodes are substantially similar in structure and operation to the similarly-reference-numbered electrodes of the FIG. 4–7 embodiment. Electron beam 140 originates in electron source means 78 which generates a supply of electrons. Electron source means 78 is disposed along a row wise edge of the panel. Upon emerging from grid means 84, beam 140 enters beam guide-isolator 142. Beam guide-isolator 142 is shown as being a substantially rectangular column comprising a pair of opposed parallel walls 144A and 144B perpendicular to back wall 148 and the faceplate (not shown). Beam guideisolator 142 provides for confining the upward travel of beam 140 to a plane parallel to the side walls of the image display panel. The illustrated form of the invention shown by FIG. 15 will be seen to be similar in many respects to the embodiment shown by FIG. 12, wherein a beam 177 is caused to be diverted through a "front plate 119"of a beam guide-isolator 71. The beam guide-isolator 142, (as in the FIG. 4–7 embodiment of the invention) is located in the low-voltage rear section of the panel contiguous to back wall 148. Beam guide-isolator 142 is responsive to relatively low beam-control voltages for directing electrons emitted by electron source means 78 into a relatively low energy electron beam; that is, a beam having an energy of no more than a few hundred electron volts. Beam guide-isolator 142 confines beam 140 and directs beam 140 perpendicular to the row-wise edge of the panel and parallel to the faceplate. Beam guide-isolator 142 also isolates beam 140 from an attractive high-gradient field of the anode, in accordance with the principles of the invention.

Each of the walls 144A and 144B have at least two electrode patterns deposited thereon; four such electrode patterns are shown in the illustrated example. Each of the patterns is electrically linked to a substantially mirror-image electrode pattern deposited on the opposed parallel wall. (The electrical links are not shown in the illustrations to avoid undue complexity thereof; the links may comprise simple interconnections deposited similarly to the electrode patterns.) The number of such electrode patterns may be more or less than four according to the invention.

Two of the pairs of electrode patterns in the embodiment shown have a configuration, spacing and electrical energization effective to confine beam 140 to beam guide-isolator 142 by means of electrostatic beam-confining fields, and to cause the beam to be diverted from a predetermined selected row. To identify the relative locations of the electrode patterns deposited on the opposed parallel walls, referenced items having a suffix "A" are shown as being deposited on one wall, and their mirror-image counterparts indicated as being deposited on the opposed parallel wall are identified by a reference number having a suffix "B". In the following exposition, reference is made primarily to components of the "A" wall, with the understanding that the description applies equally to components of the mirror-image "B" wall, as well.

A pair of electrode patterns 152A and 152B provide a front, columnwise extending beam-confining field; that is, a field 153, indicated schematically by broken lines, nearest the faceplate to restrict the egress of beam 140 from beam guide-isolator 142 towards the faceplate. It should be noted that field 153 extends fully columnwise between electrode pattern 152A and 152B. Another pair of electrode patterns, patterns 154A and 154B may be provided, this pair also provides a similar column-wise beam-confining function in that it serves to prevent egress of beam 140 in the area adjacent to back wall 148 by means of electrostatic field 155 (also indicated schematically by the broken lines) formed therebetween.

Figure 16:
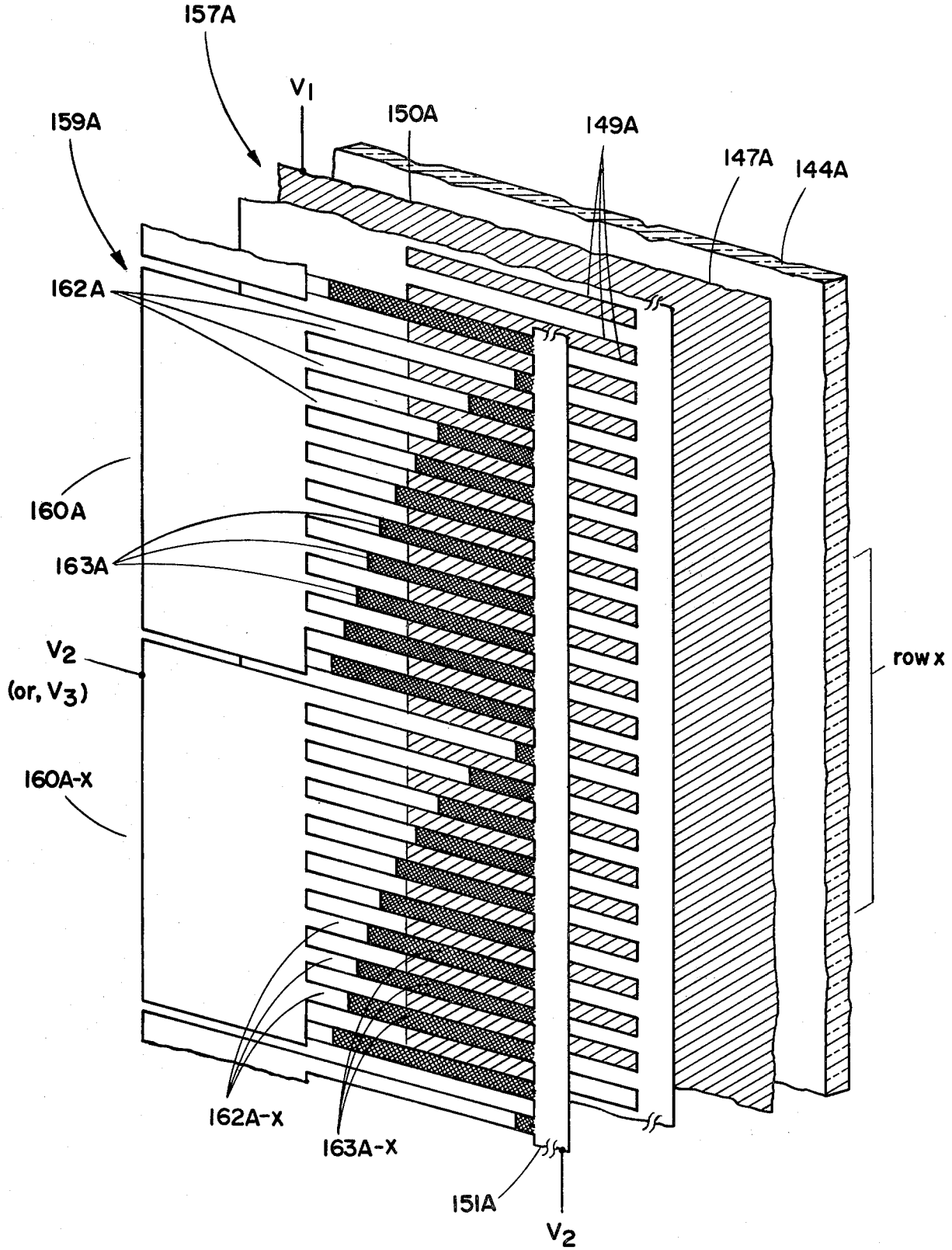
FIG. 16 is an exploded view in perspective illustrating in detail an aspect of the embodiment of the invention shown by FIG. 15.

With reference now also to FIGS. 16–19, the configuration of the electrode patterns that provide for confining the beam to beam guide-isolator 142, and for diverting the beam therefrom according to the principles of the invention, are described in greater detail. The ones of electrode patterns for each row of the panel; for example, row x of FIGS. 15 and 16, are illustrated as comprising intercalated, substantially coplanar, mutually insulated and separated, electrically energizeable first and second arrays of parallel strips. FIG. 16 shows in detail, and in exploded relationship, the structure and relative disposition of electrode patterns of two of the rows deposited on side wall 144A. The electrode patterns comprise a series of thick and thin films deposited on the insulative substrate that comprises side wall 144A. Electrode 147A, which is shown as being in the form of a sheet deposited on side wall 144A, may comprise an electrically conductive thin film having a thickness, for example, of one micron. Insulator 150A is deposited on conductive electrode 147A, and includes in its structure a series of apertures 149A. This insulator may comprise a thick film, for example, having a thickness, typically, of 50 microns. A first array 157A according to the invention comprises conductive electrode 147A which, in conjunction with apertures 149A of insulator 150A, provides a ladder-like progression of electrically conductive strips.

The strips comprising a second array 159A are shown as being once-divided into conductive segments 162A substantially coplanar and collinear with resistive segments 163A; the conductive and resistive segments are of successively varying apportionment. It will be observed that the conductive strips 162A comprise discrete electrodes 160A electrically energizeable by row. (The electrode of row x, which is representative of the electrode structure of each row in each column of the panel, is identified as 160A-x, and all associated components of electrode 160A-x are identified by the suffix x.) The resistive segments 163A-x, however, are electrically at the same potential as all other resistive segments in the column, and the electrical commonality of all resistive segments in a column is illustratively indicated by their attachment to the columnwise-extending electrically conductive strip 151A. By the means described, all resistive segments in each column of the panel may be electrically energized in common, while the conductive segments in each column may be separately electrically energized by row, in accord with this invention.

The beam guide-isolator of the invention illustratively shown by FIGS. 15–19 provides two modes of operation. A first mode of operation provides for confining the beam in its course through the beam guide-isolator. A second mode provides an electron-refractive field for diverting the beam from a predetermined selected row towards the faceplate.

In the first mode of operation, first array 157A is adapted to receive a first electrical potential $V_1$ as indicated schematically by the electrical connection so designated in FIG. 16. The distal ends of the segments of the strips comprising second array 159A are adapted to receive a common predetermined second potential $V_2$ as indicated, again schematically. Second potential $V_2$ is different from $V_1$ to create, in cooperation with the mirror-image electrode patterns, fields effective to substantially periodically focus and refocus and thereby confine the beam passing through the beam guideisolator. The strips comprising second array 159 are preferably thin-film deposits having a thickness, typically, of one micron. The resistance of the resistive segments of second array 159A is preferably in the range of $10^6$ ohms/square to $10^8$ ohms/square.

Figure 16A:
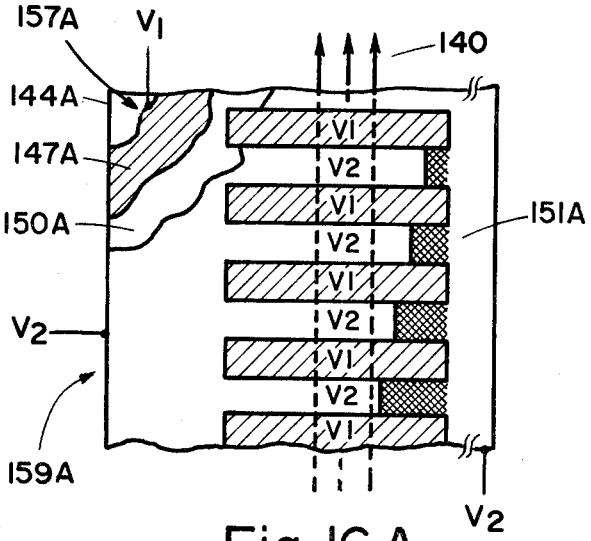
FIG. 16A is an assembled view partially cut away of a part of the aspect of the invention shown by FIG. 16.

The means by which the focusing and refocusing voltages are imposed on the beam is illustrated schematically by figure 16A, which shows a plan view of a fragment of the FIG. 16 structure, as deposited on side wall 144a. Electrode 147A, which comprises the conductive member of first array 157A, is shown as being deposited directly on side wall 144A. Potential $V_1$ applied thereto may be, for example, 60 volts. The strips comprising second array 159A, which as noted are once-divided into conductive and resistive segments of successively varying apportionments have a potential $V_2$ thereon, e.g., 20 volts. It will be recalled that the electrode patterns shown by FIGS. 16 and 16A are electrically linked, according to the inventions, to substantially mirror-image electrode patterns deposited on an opposed parallel wall. The pairs of electrically linked electrode patterns have a configuration, spacing, and electrical energization effective to confine beam 140 by means of the electrostatic beam-confining fields formed therebetween. So beam 140, in its progress through the beam-guide isolator between the opposed parallel walls, in effect "sees" a substantially periodic succession of focusing and refocusing voltages; e.g., 20 volts, 60 volts, 20 volts, etc., in this example, and is confined thereby to the beam guide-isolator.

Figure 17:
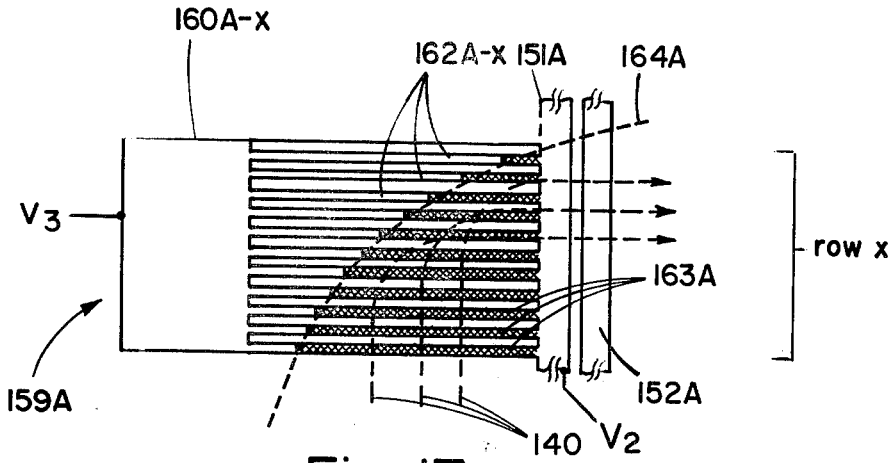
FIG. 17 is a plan view showing schematically a fragment of the electrode structure of FIGS. 15 and 16.

FIG. 17 shows schematically the means for causing the beam 140 to be diverted from the beam-guide isolator toward the faceplate according to the invention. (It will be observed that a greater number of conductive segments 162A-x and resistive segments 163A-x are shown in FIG. 17; the numbers of such segments per row are not limited to the numbers illustrated in the various figures.) In this second mode of operation, that is, in the beam-diverting mode, the distal ends of the conductive segments 162A-x of second array 159A are adapted to receive instead a third potential $V_3$ which is negative relative to $V_2$. Third potential $V_3$ may be minus 20 volts, e.g. the voltage drop $V_3$ minus $V_2$ across the resistive segments 163A-x produces across the path of beam 140 in cooperation with the opposed mirror-image electrode patterns, a family of equipotential surfaces or planes defining electron-refractive fields for diverting beam 140 from its confined course through the beam-confining field 153 formed between electrode patterns 152 and 152B towards the faceplate.

Figure 18:
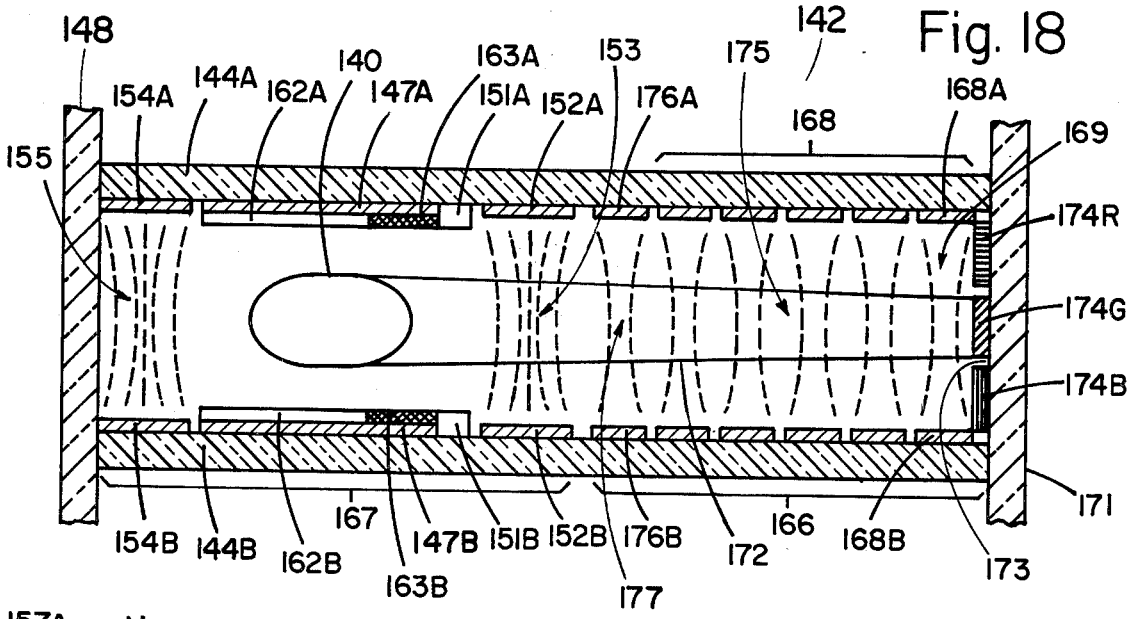
FIG. 18 is a top view in section of a beam guideisolator according to the principles of this invention.

Another view of the embodiment of the invention shown by figures 15 and 16 is shown by FIG. 18, which comprises a top view of beam guide-isolator 142. In consonance with the embodiment of the invention shown by FIG. 4, the image panel structure is shown as comprising a high-voltage front section comprising faceplate 171 and an anode 173 for receiving a relatively high voltage; that is, a voltage in the kilovolts range. A low-voltage rear section is located contiguous to back wall 148. This sectioning is indicated in relation to beam guide-isolator 142 by brackets; the high- and low-voltage sections are designated 166 and 167, respectively. High-voltage front section 166 includes the inner surface of faceplate 171, to which an anode 173 is contiguous. Anode 173 may comprise a thin film of aluminum. Red-, green- and blue-light-emitting phosphor targets 174R, 174G, and 174B are also shown as being deposited on the inner surface of faceplate 171. Anode 173 may have, for example, a potential thereon in the range of 800 volts to 10,000 volts.

Included in high-voltage front section 166 are beam-shaping electrode patterns 168, indicated by a bracket. Beam-shaping electrode patterns 168 each comprise a pair of electrically linked, substantially mirror-image electrode patterns deposited on the opposed parallel walls 144A and 144B. The beam-shaping electrode patterns 168 are typified by beam-shaping electrode pattern 168A and its electrically linked, mirror-image counterpart 168B, which are shown as having a converging electrostatic field 169 therebetween. Electrostatic field 169 is depicted as being similar in contour to a simple optical lens element. Similarly shaped fields are shown between all of the electrode pairs 168. The purpose of the shaped fields is to cause the beam 140, after it has been diverted from the beam guide-isolator, to be further caused to be diverted or shaped as it passes through the respective electrostatic fields typified by field 169.

High voltage front section 166 also includes an high-gradient field 175 formed by an increase in the electrical potential in sequence toward the faceplate on the beam-shaping electrode patterns 168; these protentials may be, successively (starting with the electrode pair nearest electrode pair 176A and 176B): one kilovolt, two kilovolts, etc., so the potential of electrode patterns 168A and 168B nearest faceplate 178 may be five kilovolts, for example. The high-gradient field 175 thus formed provides for the acceleration of the electrons of beam 140 to a high energy to brightly activate at least one of the phosphor targets 174R, 174G, or 174B. The beam-shaping electrode patterns 168 are shown as being five in number; however, there may be a greater or lesser number. The voltage values cited are not limiting but may be allotted in consonance with specific requirements.

Beam 140, after being diverted from the beam guide-isolator is shown as being focused along a path 172 to impinge upon green-light-emitting phosphor target 174G. The beam can be diverted laterally to impinge upon either red-light-emitting phosphor target 174R, or a blue-light-emitting phosphor 174B. This diverting of the beam is the result of electrostatic field 177 formed between paired electrode patterns 176A and 176B; the voltage potential may be varied upon each member of the pairs to alternatively attract and repel the beam to provide for impingement upon the desired phosphor target. Additionally, all paired electrodes shown by bracket 168 could as well be utilized in concert to provide for diverting of the beam by varying in unison the potentials thereon. Low-voltage rear section 167 is located contiguous to back wall 148 and includes pairs of electrode patterns 151A and 151B, and 154A and 154B to confine beam 140 as described heretofore. The fields generated by the electrode patterns in rear section 167 include the fields generated by the aforedescribed first array comprising electrode patterns 147A and 147B.

As noted, beam 140 may be confined in the area of back wall 147 by electrostatic field 155 formed by electrode patterns 154A and 154B. Adequate beam-confinement could as well be provided by a field generated by a difference in potential relative to electrode components contiguous to back wall 148 sufficient to repel electrons passing through the beam guide-isolator away from back wall 148.

Low-voltage rear section 167 is shown as comprising about one-third the length of beam guide-isolator 142--a ratio made necessary for illustrative purposes to show necessary detail. In actuality, the ratio would more likely be one to ten; that is, the low-voltage rear section 167 may comprise one-tenth the length of beam guide-isolator 142, with the high-voltage front section 166 comprising nine-tenths of the length. It is to be noted that this ratio is not limiting but is cited only for purposes of example.

The electrode patterns which, according to the invention, provide for beam confining and beam diverting, are shown as being deposited on opposed parallel walls. Each of the patterns is electrically linked to a substantially mirror-image pattern deposited on the opposed parallel wall. The pairs of electrode patterns can comprise printed-on depositions, according to the teachings of the invention. The depositions can be formed by any of a number of well-known printing means, such as letterpress, lithography, intaglio, stencilling, or electrographics. The advantages of printed-on depositions include the fact that opposed pairs of electrodes according to the invention can comprise substantially mirror-images; also, the patterns comprising the pairs will be matched in electrical properties and will be substantially identical in performance to all other electrode patterns having similar functions throughout the panel.

With reference to electrode 160A-x of row x, comprising second array 159A, the shape of the aforedescribed family of equipotential planes or surfaces is determined substantially by the locus of the junctions of the conductive segments 162A-x and resistive segments 163A-x. In the embodiment of the invention shown by figures 15 and 16, and more specifically, by FIG. 17, the junctions of conductive segments 162A-x and resistive segments 163A-x are shown as forming a locus or curve 164A that arches upwardly and towards the faceplate. The locus of the junctions of these segments need not form the curve as shown; alternatively, and in accord with the teachings of the invention, the curve could as well arch away from the faceplate and towards the back wall; also, the junctions could as well form a straight line.

Figure 19:
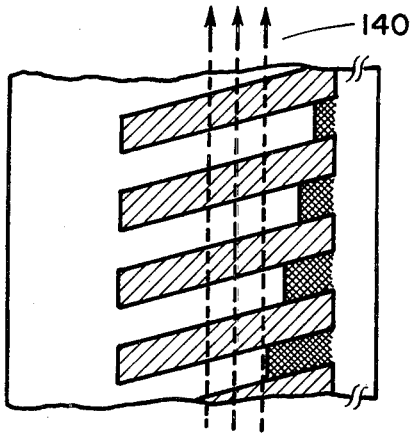
FIG. 19 is a view of a part of the embodiment of FIG. 16, altered to show another aspect of the invention.

The strips that provide for beam-confining and beam-diverting are shown in figures 15–17 as being oriented substantially perpendicular to the plane of back wall 148. It is also in accord with the invention that the strips be oriented non-perpendicularly to the plane of the back wall, as shown by figure 19. The angle is indicated as being approximately 15 degrees from the aforesaid perpendicular; the angle of the strips could as well be of a greater or lesser degree, all according to the teachings of the invention.

Electrodes 151A, 152A and 152B and 154A and 154B are shown as being relatively narrow in the various figures. The width dimension shown is nowise so limited; these and other electrodes maybe wider or narrower depending upon the design requirements of a specific display panel and still be in accord with the teachings of this invention. Any dimensional limitations which may seem to be indicated by the figures is necessary for illustrative purposes to make possible the simplest and clearest graphical exposition of a preferred embodiment according to the teachings of the invention.

The beam-diverting means according to the invention lends itself to diverting an electron beam from beam-confining structures other than those disclosed herein; an example is beam-guiding means that provides for beam confining by "slalom" focusing. Such a beam guide could conceiveably be utilized in a display panel having electron-beam-generating means disposed along an edge of the panel. The beam generated is directed into a beam guide comprising a substantially rectangular column having a pair of opposed parallel walls substantially perpendicular to a back wall and faceplate of the panel. The beam guide includes beam-confining means for restricting the egress of the beam from the beam guide, and beam-diverting means according to the invention comprising at least one electrode pattern disposed on each of the opposed parallel walls, with each of the patterns being electrically linked to a substantially mirror-image electrode pattern deposited on the opposed parallel wall to comprise a pair. The pairs of electrode patterns have a configuration, spacing and electrical energization effective to divert the beam from the beam guide by means of electrostatic beam-diverting fields. The pairs of electrode patterns for each row each comprise an array of parallel strips once-divided into conductive and resistive segments of successively varying apportionment. The conductive segments are adapted to receive a predetermined first potential, and the respective distal ends of the resistive segments are adapted to receive a predetermined second potential which is negative with respect to the first potential. As a result, the voltage drop across the resistive segments produces across the path of the beam in cooperation with the opposed mirrorimage electrode pattern, a family of equipotential surfaces defining electron-refractive fields for diverting the beam from the beam confining means of the beam guide towards the faceplate.

It is to be understood that the description of the invention claimed herein is not intended to be exhaustive nor limiting of the invention, but is given to purposes of illustration in order that others skilled in the art may fully understand the invention and the principles thereof and the matter of applying it in practical use so that they may modify it in various forms, each as may be best suited to the conditions of a particular use, and all according to the principles of the invention herein set forth.

I claim:

1. An image display panel comprising an evacuated envelope having a back wall, side walls, and a faceplate having an anode and an ordered array of rows and columns of phosphor targets deposited on an inner surface thereof, said panel including electron beam generating means disposed along an edge of said panel, said beam being directed into a beam guide comprising a substantially rectangular column having a pair of opposed parallel walls substantially perpendicular to said back wall and said faceplate, said beam guide including beam-confining means for restricting egress of said beam from said beam guide, said panel including beam-diverting means comprising at least one electrode pattern disposed on each of said opposed parallel walls, each of said patterns being electrically linked to a substantially mirror-image electrode pattern deposited on the opposed parallel wall to comprise a pair, the pairs of electrode patterns having a configuration, spacing and electrical energization effective to divert said beam from said beam guide by means of electrostatic beam-diverting fields, the pairs of electrode patterns for each row each comprising an array of parallel strips once-divided into conductive and resistive segments of successively varying apportionment, said conductive segments being adapted to receive a predetermined first potential and the respective distal ends of said resistive segmemts being adapted to receive a predetermined second potential which is negative with respect to said first potential such that the voltage drop across said resistive segments produces across the path of said beam in cooperation with the opposed mirror-image electrode pattern, a family of equipotential surfaces defining electron-refractive fields for diverting said beam from said beam-confining means of said beam-guide towards said faceplate.

2. The image-display panel defined by claim 1 wherein the locus of the junctions of said conductive and resistive segments form a curve arching upwardly and towards said faceplate to define said equipotential surfaces.

3. A cathodoluminescent image display panel comprising an evacuated envelope having a back wall, side walls, and a faceplate having an anode and an ordered array of rows and columns of phosphor targets deposited on an inner surface thereof, said panel being partitioned into two distinct sections comprising:

a high-voltage front section comprising said faceplate and said anode for receiving a relatively high voltage; that is, a voltage in the kilovolts range; and a low-voltage rear section located contiguous to said back wall and comprising:

electron source means disposed along a row-wise edge of said panel for generating a supply of electrons;

at least one beam guide-isolator located in said rear section responsive to relatively low applied beam-control voltages for directing electrons emitted by said electron source means into a relatively low-energy electron beam; that is, a beam having an energy of no more than a few hundred electron volts, and for confining said beam to said beam guide-isolator and directing the beam perpendicular to said row-wise edge and parallel to said faceplate, and for isolating said beam from an attractive highgradient field of said anode, said beam guideisolator comprising:

a substantially rectangular column comprising a pair of opposed parallel walls perpendicular to said back wall and said faceplate, each of said walls having deposited thereon at least two electrode patterns each electrically linked to a substantially mirror-image electrode pattern deposited on the opposed parallel wall, the pairs of electrode patterns having a configuration, spacing and electrical energization effective to confine said beam by means of electrostatic beam-confining fields including a front beam-confining field; that is, a field nearest said faceplate to restrict egress of the beam towards said faceplate, the ones of electrode patterns for each row of said panel comprising intercalated, substantially coplanar, mutually insulated and separated, electrically energizable first and second arrays of parallel strips, the strips comprising said first array being electrically conductive, the strips comprising said second array being once-divided into conductive and resistive segments of successively varying apportionments; in a first mode of operation of said beam guideisolator, said first array being adapted to receive a first electrical potential $V_1$, and the distal ends of said segments of said strips comprising said second array being adapted to receive a common predetermined second potential $V_2$ different from $V_1$ to create, in cooperation with said mirror image electrode patterns, fields effective to substantially periodically focus and refocus and thereby confine said beam; and in a second mode of operation of said beam guide-isolator said distal ends of said conductive segments being adapted to receive instead of a third potential $V_3$ which is negative relative to $V_2$ such that the voltage drop $V_3$ minus $V_2$ across said resistive segments produces across the path of said beam in cooperation with said opposed mirror-image electrode patterns, a family of equipotential surfaces defining electron-refractive fields for diverting said beam through said beamconfining field toward said faceplate.

4. The image display panel defined by claim 3 wherein the locus of the junctions of said conductive and resistive segments form a curve arching upwardly and toward said faceplate to define said equipotential surfaces.

5. The display panel defined by claim 3 wherein said strips are oriented substantially perpendicular to the plane of the back wall of said panel.

6. The display panel defined by claim 3 wherein said strips are oriented non-perpendicularly to the plane of the back wall of said panel.

7. The display panel defined by claim 3 wherein said pairs of electrode patterns are printed-on depositions.

* * * * *